US007473334B2

(12) United States Patent
Wong Shing et al.

(10) Patent No.: US 7,473,334 B2
(45) Date of Patent: Jan. 6, 2009

(54) METHOD OF PREPARING MODIFIED DIALLYL-N,N-DISUBSTITUTED AMMONIUM HALIDE POLYMERS

(75) Inventors: Jane B. Wong Shing, Aurora, IL (US); Alessandra Gerli, Leiden (NL); Xavier S. Cardoso, Leiden (NL); Angela P. Zagala, Naperville, IL (US); Przem Pruszynski, Naperville, IL (US); Cathy C. Doucette, Sugar Grove, IL (US)

(73) Assignee: Nalco Company, Naperville, IL (US)

( * ) Notice: Subject to any disclaimer, the term of this patent is extended or adjusted under 35 U.S.C. 154(b) by 354 days.

(21) Appl. No.: 10/966,476

(22) Filed: Oct. 15, 2004

(65) Prior Publication Data

US 2006/0084772 A1 Apr. 20, 2006

(51) Int. Cl.
*D21H 17/45* (2006.01)
*D21H 21/10* (2006.01)
*C08F 2/32* (2006.01)

(52) U.S. Cl. ..... 162/164.6; 162/158; 162/168.3; 162/183; 162/185; 526/72; 526/80; 526/87; 526/312

(58) Field of Classification Search ..... 162/158, 162/164.6, 168.3, 183, 185; 526/72, 80, 526/87, 312
See application file for complete search history.

(56) References Cited

U.S. PATENT DOCUMENTS 4,795,531 A * 1/1989 Sofia et al. ..... 162/164.6
5,098,520 A * 3/1992 Begala ..... 162/168.1
5,167,766 A 12/1992 Honig et al.
5,171,783 A * 12/1992 Gartner ..... 524/801
5,254,221 A 10/1993 Lowry et al.
5,274,055 A 12/1993 Honig et al.
5,597,858 A * 1/1997 Ramesh et al. ..... 524/458
5,858,174 A * 1/1999 Persson et al. ..... 162/164.1
5,876,563 A * 3/1999 Greenwood ..... 162/175
5,945,494 A * 8/1999 Neff et al. ..... 526/292.2
6,033,524 A * 3/2000 Pruszynski et al. ..... 162/165
6,059,930 A * 5/2000 Wong Shing et al. .... 162/168.2
6,071,379 A 6/2000 Wong Shing et al.
6,124,396 A * 9/2000 Hahn et al. ..... 524/801
6,398,967 B2 * 6/2002 Sparapany et al. ..... 210/708
6,432,271 B1 * 8/2002 Wong Shing et al. .... 162/168.3
6,517,677 B1 * 2/2003 Cardile et al. ..... 162/168.3
6,592,718 B1 7/2003 Wong Shing et al.
6,605,674 B1 8/2003 Whipple et al.

OTHER PUBLICATIONS

Hunter, C.; Henderson, K; McInnis, P.; Miknevich, J.; "A New Generation of Copolymers for Retention—Drainage-Formation And Coated Broke Applications"; TAPPI 99 Preparing for the Next Millennium; vol. 3, pp. 1345-1352; TAPPI Press; 1999.

* cited by examiner

*Primary Examiner*—Eric Hug
*Assistant Examiner*—Dennis Cordray
(74) *Attorney, Agent, or Firm*—Michael B. Martin

(57) ABSTRACT

A method of preparing a modified diallyl-N,N-disubstituted ammonium halide polymer and use of the polymer in combination with one or more high molecular weight, water soluble cationic, anionic, nonionic, zwitterionic or amphoteric polymers for increasing retention and drainage in a papermaking furnish.

31 Claims, No Drawings

METHOD OF PREPARING MODIFIED DIALLYL-N,N-DISUBSTITUTED AMMONIUM HALIDE POLYMERS

TECHNICAL FIELD

This invention concerns a method of preparing modified diallyl-N,N-disubstituted ammonium halide polymers and use of the polymers in combination with one or more high molecular weight, water soluble cationic, anionic, nonionic, zwitterionic or amphoteric polymer flocculants for improving retention and drainage in papermaking processes.

BACKGROUND OF THE INVENTION

U.S. Pat. No. 6,605,674 describes the preparation of structurally-modified cationic polymers where monomers are polymerized under free radical polymerization conditions in which a structural modifier is added to the polymerization after about 30 percent polymerization of the monomers has occurred and use of the polymers as retention and drainage aids in papermaking processes.

The use of medium molecular weight diallyldimethylammonium chloride/acrylamide copolymers as retention and drainage aids is reviewed in Hunter et al., "*TAPPI 99 Preparing for the Next Millennium*", vol. 3, pp. 1345-1352, TAPPI Press (1999).

U.S. Pat. No. 6,071,379 discloses the use of diallyl-N,N-disubstituted ammonium halide/acrylamide dispersion polymers as retention and drainage aids in papermaking processes.

U.S. Pat. No. 5,254,221 discloses a method of increasing retention and drainage in a papermaking process using a low to medium molecular weight diallyldimethylammonium chloride/acrylamide copolymer in combination with a high molecular weight dialkylaminoalkyl (meth)acrylate quaternary ammonium salt/acrylamide copolymer.

U.S. Pat. No. 6,592,718 discloses a method of improving retention and drainage in a papermaking furnish comprising adding to the furnish a diallyl-N,N-disubstituted ammonium halide/acrylamide copolymer and a high molecular weight structurally-modified, water-soluble cationic polymer.

U.S. Pat. Nos. 5,167,776 and 5,274,055 disclose ionic, cross-linked polymeric microbeads having a diameter of less than about 1,000 nm and use of the microbeads in combination with a high molecular weight polymer or polysaccharide in a method of improving retention and drainage of a papermaking furnish.

Nonetheless, there is a continuing need for new compositions and processes to further improve retention and drainage performance, particularly for use on the faster and bigger modern papermaking machines currently being put into use.

SUMMARY OF THE INVENTION

This invention is a method of preparing a modified diallyl-N,N-disubstituted ammonium halide polymer having a cationic charge of about 1 to about 99 mole percent comprising (a) preparing an aqueous solution comprising one or more diallyl-N,N-disubstituted ammonium halide monomers and about 15 to about 95 percent of the total acrylamide monomer;

(b) initiating polymerization of the monomers;

(c) allowing the polymerization to proceed to at least about 5 percent diallyl-N,N-disubstituted ammonium halide monomer conversion and at least about 20 percent acrylamide monomer conversion; and (d) adding the remaining acrylamide monomer and allowing the polymerization to proceed to the desired endpoint, wherein the polymerization is conducted in the presence of about 0.1 to about 150,000 ppm, based on monomer, of one or more chain transfer agents and optionally about 1 to about 30,000 ppm, based on monomer, of one or more cross-linking agents The polymer program of this invention outperforms other multi component programs referred to as microparticle programs using colloidal silica or bentonite that are typically used in the paper industry.

DETAILED DESCRIPTION OF THE INVENTION

Definitions of Terms

"Acrylamide monomer" means a monomer of formula

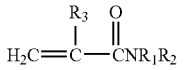

wherein $R_1$, $R_2$ and $R_3$ are independently selected from H and alkyl. Preferred acrylamide monomers are acrylamide and methacrylamide. Acrylamide is more preferred.

"Alkyl" means a monovalent group derived from a straight or branched chain saturated hydrocarbon by the removal of a single hydrogen atom. Representative alkyl groups include methyl, ethyl, n- and iso-propyl, cetyl, and the like.

"Alkylene" means a divalent group derived from a straight or branched chain saturated hydrocarbon by the removal of two hydrogen atoms. Representative alkylene groups include methylene, ethylene, propylene, and the like.

"Based on polymer active" and "based on monomer" mean the amount of a reagent added based on the level of vinylic monomer in the formula, or the level of polymer formed after polymerization, assuming 100 percent conversion.

"Chain transfer agent" means any molecule, used in free-radical polymerization, which will react with a polymer radical forming a dead polymer and a new radical. In particular, adding a chain transfer agent to a polymerizing mixture results in a chain-breaking and a concommitant decrease in the size of the polymerizing chain. Thus, adding a chain transfer agent limits the molecular weight of the polymer being prepared. Representative chain transfer agents include alcohols such as methanol, ethanol, 1-propanol, 2-propanol, butyl alcohol, glycerol, and polyethyleneglycol and the like, sulfur compounds such as alkylthiols, thioureas, sulfites, and disulfides, carboxylic acids such as formic and malic acid, and their salts and phosphites such as sodium hypophosphite, and combinations thereof. See Berger et al., "*Transfer Constants to Monomer, Polymer, Catalyst, Solvent, and Additive in Free Radical Polymerization*," Section II, pp. 81-151, in "*Polymer Handbook*," edited by J. Brandrup and E. H. Immergut, 3d edition, John Wiley & Sons, New York (1989) and George Odian, *Principles of Polymerization,* second edition, John Wiley & Sons, New York (1981). A preferred alcohol is 2-propanol. Preferred sulfur compounds include ethanethiol, thiourea, and sodium bisulfite. Preferred carboxylic acids include formic acid and its salts. More preferred chain-transfer agents are sodium hypophosphite and sodium formate.

"Cross-linking agent" means a multifunctional compound that when added to polymerizing monomer or monomers results in "cross-linked" and/or branched polymers in which a branch or branches from one polymer molecule become attached to other polymer molecules. Representative cross-linking agents include N,N-methylenebisacrylamide, N,N-methylenebismethacrylamide, triallylamine, triallyl ammonium salts, ethylene glycol dimethacrylate, diethylene glycol dimethacrylate, polyethylene glycol diacrylate, triethylene glycol dimethylacrylate, polyethylene glycol dimethacrylate, N-vinylacrylamide, N-methylallylacrylamide, glycidyl acrylate, acrolein, glyoxal, gluteraldehyde, formaldehyde and vinyltrialkoxysilanes such as vinyltrimethoxysilane (VTMS), vinyltriethoxysilane, vinyltris(β-methoxyethoxy) silane, vinyltriacetoxysilane, allyltrimethoxysilane, allyltriacetoxysilane, vinylmethyldimethoxysilane, vinyldimethoxyethoxysilane, vinylmethyldiacetoxysilane, vinyldimethylacetoxysilane, vinylisobutyldimethoxysilane, vinyltriisopropoxysilane, vinyltri-n-butoxysilane, vinyltrisecbutoxysilane, vinyltrihexyloxysilane, vinylmethoxydihexyloxysilane, vinyldimethoxyoctyloxysilane, vinylmethoxydioctyloxysilane, vinyltrioctyloxysilane, vinylmethoxydilauryloxysilane, vinyldimethoxylauryloxysilane, vinylmethoxydioleyloxysilane, and vinyldimethoxyoleyloxysilane, and the like. Preferred cross-linkers include N,N-methylenebisacrylamide, triallylamine, triallyl ammonium salts and glyoxal.

"Diallyl-N,N-disubstituted ammonium halide monomer" means a monomer of formula $$(H_2C{=}CHCH_2)_2N^+R_4R_5X^-$$

wherein $R_4$ and $R_5$ are independently $C_1$-$C_{20}$ alkyl, aryl or arylalkyl and X is an anionic counterion. Representative anionic counterions include halogen, sulfate, nitrate, phosphate, and the like. A preferred anionic counterion is halogen. A preferred diallyl-N,N-disubstituted ammonium halide monomer is diallyldimethylammonium chloride.

"Halogen" means fluorine, chlorine, bromine or iodine.

"Modified diallyl-N,N-disubstituted ammonium halide polymer" means a polymer of one or more diallyl-N,N-disubstituted ammonium halide monomers and one or more acrylamide monomers where the monomers are polymerized as described herein in the presence of one or more chain transfer agents and optionally one or more cross-linking agents in order to impart the desired characteristics to the resulting polymer.

"RSV" stands for reduced specific viscosity. Within a series of polymer homologs which are substantially linear and well solvated, "reduced specific viscosity (RSV)" measurements for dilute polymer solutions are an indication of polymer chain length and average molecular weight according to Paul J. Flory, in "*Principles of Polymer Chemistry*", Cornell University Press, Ithaca, N.Y., © 1953, Chapter VII, "*Determination of Molecular Weights*", pp. 266-316. The RSV is measured at a given polymer concentration and temperature and calculated as follows:

$$RSV = \frac{[(\eta/\eta_0) - 1]}{c}$$

$\eta$=viscosity of polymer solution $\eta_o$=viscosity of solvent at the same temperature c=concentration of polymer in solution.

The units of concentration "c" are (grams/100 ml or g/deciliter). Therefore, the units of RSV are dL/g. In this patent application, a 1.0 molar sodium nitrate solution is used for measuring RSV, unless specified. The polymer concentration in this solvent is 0.045 g/dL. The RSV is measured at 30° C. The viscosities $\eta$ and $\eta_o$ are measured using a Cannon Ubbelohde semimicro dilution viscometer, size 75. The viscometer is mounted in a perfectly vertical position in a constant temperature bath adjusted to 30±0.02° C. The typical error inherent in the calculation of RSV for the polymers described herein is about 0.2 dL/g. When two polymer homologs within a series have similar RSV's that is an indication that they have similar molecular weights.

"IV" stands for intrinsic viscosity, which is RSV extrapolated to the limit of infinite dilution, infinite dilution being when the concentration of polymer is equal to zero.

"Papermaking process" means a method of making paper products from pulp comprising forming an aqueous cellulosic papermaking furnish, draining the furnish to form a sheet and drying the sheet. The steps of forming the papermaking furnish, draining and drying may be carried out in any conventional manner generally known to those skilled in the art. Conventional microparticles, alum, cationic starch or a combination thereof may be utilized as adjuncts with the polymer treatment of this invention, although it must be emphasized that no adjunct is required for effective retention and drainage activity.

PREFERRED EMBODIMENTS

Modified diallyl-N,N-disubstituted ammonium halide polymers are prepared by polymerization of one or more diallyl-N,N-disubstituted ammonium halide monomers and one or more acrylamide monomers under free radical forming conditions in the presence of one or more chain transfer agents and optionally one or more cross-linking agents as described below.

In the polymerization method of this invention, an aqueous solution comprising the diallyl-N,N-disubstituted ammonium halide monomer, chain transfer agent, any cross-linking agent and about 15 to about 95, preferably about 35 to about 85 percent of the total acrylamide monomer is prepared and the monomers are polymerized under free-radical conditions until at least about 5 percent diallyl-N,N-disubstituted ammonium halide monomer conversion and at least about 20 percent acrylamide monomer conversion is achieved. Measurement of monomer conversion is known in the art. See, for example, Leonard M. Ver Vers, "Determination of Acrylamide Monomer in Polyacrylamide Degradation Studies by High-Performance Liquid Chromatography", *Journal of Chromatographic Science,* 37, 486-494 (1999).

At this point, the remaining acrylamide monomer is added and the polymerization is allowed to proceed to the desired endpoint, for example until the desired molecular weight, charge density or monomer conversion is obtained.

The amounts of cross-linking agent and chain transfer agents and the polymerization conditions are selected such that the modified polymer has a charge density of less than about 7 milliequivalents per gram of polymer and a reduced specific viscosity of about 0.2 to about 12 dL/g. The modified polymer is also characterized in that it has a number average particle size diameter of at least 1,000 nm if crosslinked and at least about 100 nm if non crosslinked.

The chain-transfer agents may be added all at once at the start of polymerization or continuously or in portions during the polymerization of the monomers. The chain transfer agents may also be added after polymerization of a portion of the monomers has occurred as described in U.S. Pat. No. 6,605,674 B1. The level of chain transfer agent used depends on the efficiency of the chain transfer agent, the monomer concentration, the degree of polymerization at which it is added, the extent of polymer solubility desired and the polymer molecular weight desired. Typically, about 0.1 to about 150,000 ppm of chain transfer agent, based on monomer, is used to prepare the modified polymer.

In addition to the chain transfer agents, the monomers may also be polymerized in the presence of one or more cross-linking agents. When a combination of chain transfer agents and cross-linking agents is used, the amounts of each may vary widely based on the chain-transfer constant "efficiency" of the chain-transfer agent, the multiplicity and "efficiency" of the cross-linking agent, and the point during the polymerization where each is added. For example from about 1,000 to about 10,000 ppm (based on monomer) of a moderate chain transfer agent such as isopropyl alcohol may be suitable while much lower amounts, typically from about 100 to about 1,000 ppm, of more effective chain transfer agents such as mercaptoethanol are useful. Representative combinations of cross-linkers and chain transfer agents contain about 0.1 to about 150,000 ppm, preferably about 0.1 to about 50,000, more preferably about 0.1 to about 30,000 ppm and still more preferably about 0.1 to about 10,000 ppm (based on monomer) of chain transfer agent and about 1 to about 30,000, preferably about 1 to about 2,000 and more preferably about 5 to about 500 ppm (based on monomer) of cross-linking agent.

Preferred modified diallyl-N,N-disubstituted ammonium halide polymers are selected from the group consisting of inverse emulsion polymers, dispersion polymers, solution polymers and gel polymers.

"Inverse emulsion polymer" means a water-in-oil polymer emulsion comprising a cationic, anionic, amphoteric, zwitterionic or nonionic polymer according to this invention in the aqueous phase, a hydrocarbon oil for the oil phase and a water-in-oil emulsifying agent. Inverse emulsion polymers are hydrocarbon continuous with the water-soluble polymers dispersed within the hydrocarbon matrix. The inverse emulsion polymers are then "inverted" or activated for use by releasing the polymer from the particles using shear, dilution, and, generally, another surfactant. See U.S. Pat. No. 3,734,873, incorporated herein by reference. Representative preparations of high molecular weight inverse emulsion polymers are described in U.S. Pat. Nos. 2,982,749; 3,284,393; and 3,734,873. See also, Hunkeler, et al., "*Mechanism, Kinetics and Modeling of the Inverse-Microsuspension Homopolymerization of Acrylamide,*" *Polymer,* vol. 30(1), pp 127-42 (1989); and Hunkeler et al., "*Mechanism, Kinetics and Modeling of Inverse-Microsuspension Polymerization: 2. Copolymerization of Acrylamide with Quaternary Ammonium Cationic Monomers,*" *Polymer,* vol. 32(14), pp 2626-40 (1991).

The aqueous phase is prepared by mixing together in water one or more water-soluble monomers, and any polymerization additives such as inorganic salts, chelants, pH buffers, and the like.

The oil phase is prepared by mixing together an inert hydrocarbon liquid with one or more oil soluble surfactants. The surfactant mixture should have a hydrophilic-lypophilic balance (HLB) that ensures the formation of a stable oil continuous emulsion. Appropriate surfactants for water-in-oil emulsion polymerizations, which are commercially available, are compiled in the North American Edition of McCutcheon's *Emulsifiers& Detergents*. The oil phase may need to be heated to ensure the formation of a homogeneous oil solution.

The oil phase is then charged into a reactor equipped with a mixer, a thermocouple, a nitrogen purge tube, and a condenser. The aqueous phase is added to the reactor containing the oil phase with vigorous stirring to form an emulsion. The resulting emulsion is heated to the desired temperature, purged with nitrogen, and a free-radical initiator is added. The reaction mixture is stirred for several hours under a nitrogen atmosphere at the desired temperature. Upon completion of the reaction, the water-in-oil emulsion polymer is cooled to room temperature, where any desired post-polymerization additives, such as antioxidants, or a high HLB surfactant (as described in U.S. Pat. No. 3,734,873) may be added.

The resulting inverse emulsion polymer is a free-flowing liquid. An aqueous solution of the water-in-oil emulsion polymer can be generated by adding a desired amount of the inverse emulsion polymer to water with vigorous mixing in the presence of a high-HLB surfactant (as described in U.S. Pat. No. 3,734,873).

"Dispersion polymer" means a dispersion of fine particles of polymer in an aqueous salt solution, which is prepared by polymerizing monomers with stirring in an aqueous salt solution in which the resulting polymer is insoluble. See U.S. Pat. Nos. 5,708,071; 4,929,655; 5,006,590; 5,597,859; 5,597,858 and European Patent Nos. 657,478 and 630,909.

In a typical procedure for preparing a dispersion polymer, an aqueous solution containing one or more inorganic or hydrophobic salts, one or more water-soluble monomers, any polymerization additives such as processing aids, chelants, pH buffers and a water-soluble stabilizer polymer is charged to a reactor equipped with a mixer, a thermocouple, a nitrogen purging tube, and a water condenser. The monomer solution is mixed vigorously, heated to the desired temperature, and then an initiator is added. The solution is purged with nitrogen while maintaining temperature and mixing for several hours. After this time, the mixture is cooled to room temperature, and any post-polymerization additives are charged to the reactor. Water continuous dispersions of water-soluble polymers are free flowing liquids with product viscosities generally 100-10,000 cP, measured at low shear.

In a typical procedure for preparing solution and gel polymers, an aqueous solution containing one or more water-soluble monomers and any additional polymerization additives such as chelants, pH buffers, and the like, is prepared. This mixture is charged to a reactor equipped with a mixer, a thermocouple, a nitrogen purging tube and a water condenser. The solution is mixed vigorously, heated to the desired temperature, and then one or more polymerization initiators are added. The solution is purged with nitrogen while maintaining temperature and mixing for several hours. Typically, the viscosity of the solution increases during this period. After the polymerization is complete, the reactor contents are cooled to room temperature and then transferred to storage. Solution and gel polymer viscosities vary widely, and are dependent upon the concentration and molecular weight of the active polymer component. The solution/gel polymer can be dried to give a powder.

The polymerization reactions described herein are initiated by any means which results in generation of a suitable free-radical. Thermally derived radicals, in which the radical species results from thermal, homolytic dissociation of an azo, peroxide, hydroperoxide and perester compound are preferred. Especially preferred initiators are azo compounds including 2,2'-azobis(2-amidinopropane)dihydrochloride, 2,2'-azobis[2-(2-imidazolin-2-yl)propane]dihydrochloride, 2,2'-azobis(isobutyronitrile) (AIBN), 2,2'-azobis(2,4-dimethylvaleronitrile) (AIVN), and the like.

In a preferred aspect of this invention, the modified diallyl-N,N-disubstituted ammonium halide polymer has a RSV of from about 0.2 to about 12 dL/g and a charge density of less than about 7 milliequivalents/g polymer.

In another preferred aspect, the diallyl-N,N-disubstituted ammonium halide monomer is diallyldimethylammonium chloride and the acrylamide monomer is acrylamide.

In another preferred aspect, the diallyl-N,N-disubstituted ammonium halide polymer has a cationic charge of about 20 to about 80 mole percent.

In another preferred aspect, the modified diallyl-N,N-disubstituted ammonium halide polymer has a RSV of about 1 to about 10 dL/g.

In another preferred aspect, the chain transfer agent is selected from sodium formate and sodium hypophosphite.

In another preferred aspect, the polymerization is conducted in the presence of about 0.1 to about 50,000 ppm, based on monomer, of sodium formate.

In another preferred aspect, the polymerization is conducted in the presence of about 0.1 to about 30,000 ppm, based on monomer, of sodium formate.

In another preferred aspect, the polymerization is conducted in the presence of about 0.1 to about 10,000 ppm, based on monomer, of sodium formate.

In another preferred aspect, the polymerization is conducted in the presence of about 0.1 to about 3,000 ppm, based on monomer, of sodium formate.

In another preferred aspect, the chain transfer agent is sodium formate and the cross-linking agent is N,N-methylenebisacrylamide.

In another preferred aspect, the modified diallyl-N,N-disubstituted ammonium halide polymer is composed of about 30 to about 70 mole percent diallyldimethylammonium chloride monomer and about 30 to about 70 mole percent acrylamide monomer and has a charge density of less than about 6 milliequivalents/g polymer and a RSV of less than about 8 dL/g.

In another embodiment of this invention, the modified modified diallyl-N,N-disubstituted ammonium halide polymer is used in combination with an effective amount of one or more cationic, anionic, nonionic, zwitterionic or amphoteric polymer flocculants in order to increase retention and drainage in a papermaking furnish. Suitable flocculants generally have molecular weights in excess of 1,000,000 and often in excess of 5,000,000. The polymeric flocculant is typically prepared by vinyl addition polymerization of one or more cationic, anionic or nonionic monomers, by copolymerization of one or more cationic monomers with one or more nonionic monomers, by copolymerization of one or more anionic monomers with one or more nonionic monomers, by copolymerization of one or more cationic monomers with one or more anionic monomers and optionally one or more nonionic monomers to produce an amphoteric polymer or by polymerization of one or more zwitterionic monomers and optionally one or more nonionic monomers to form a zwitterionic polymer. One or more zwitterionic monomers and optionally one or more nonionic monomers may also be copolymerized with one or more anionic or cationic monomers to impart cationic or anionic charge to the zwitterionic polymer.

While cationic polymer flocculants may be formed using cationic monomers, it is also possible to react certain nonionic vinyl addition polymers to produce cationically charged polymers. Polymers of this type include those prepared through the reaction of polyacrylamide with dimethylamine and formaldehyde to produce a Mannich derivative.

Similarly, while anionic polymer flocculants may be formed using anionic monomers, it is also possible to modify certain nonionic vinyl addition polymers to form anionically charged polymers. Polymers of this type include, for example, those prepared by the hydrolysis of polyacrylamide.

The flocculant may be used in the solid form, as an aqueous solution, as a water-in-oil emulsion, or as dispersion in water. Representative cationic polymers include copolymers and terpolymers of (meth)acrylamide with dimethylaminoethyl methacrylate (DMAEM), dimethylaminoethyl acrylate (DMAEA), diethylaminoethyl acrylate (DEAEA), diethylaminoethyl methacrylate (DEAEM) or their quaternary ammonium forms made with dimethyl sulfate, methyl chloride or benzyl chloride.

In a preferred aspect of this invention, the flocculants have a RSV of at least about 3 dL/g.

In another preferred aspect, the flocculants have a RSV of at least about 10 dL/g.

In another preferred aspect, the flocculants have a RSV of at least about 15 dL/g.

In another preferred aspect, the flocculant is selected from the group consisting of dimethylaminoethylacrylate methyl chloride quaternary salt-acrylamide copolymers.

In another preferred aspect, the flocculant is selected from the group consisting of sodium acrylate-acrylamide copolymers and hydrolyzed polyacrylamide polymers.

The effective amount of the modified diallyl-N,N-disubstituted ammonium halide polymer and the polymer flocculant depend on the characteristics of the particular papermaking furnish and can be readily determined by one of ordinary skill in the papermaking art. Typical dosages of the modified diallyl-N,N-disubstituted ammonium halide polymer are from about 0.01 to about 10, preferably from about 0.05 to about 5 and more preferably from about 0.1 to about 1 kg polymer actives/ton solids in the furnish.

Typical dosages of the polymer flocculant are from about 0.005 to about 10, preferably from about 0.01 to about 5 and more preferably from about 0.05 to about 1 kg polymer actives/ton solids in the furnish.

The order and method of addition of the modified diallyl-N,N-disubstituted ammonium halide polymer and the polymer flocculant are not critical and can be readily determined by one of ordinary skill in the papermaking art. However, the following are preferred.

In one preferred method of addition, the polymer flocculant and modified diallyl-N,N-disubstituted ammonium halide polymer are dosed separately to the thin stock with the modified diallyl-N,N-disubstituted ammonium halide polymer added first followed by addition of the polymer flocculant.

In another preferred method of addition, the polymer flocculant and modified diallyl-N,N-disubstituted ammonium halide polymer are dosed separately to the thin stock with the polymer flocculant added first followed by the modified diallyl-N,N-disubstituted ammonium halide polymer.

In another preferred method of addition, the modified diallyl-N,N-disubstituted ammonium halide polymer is added to tray water, e.g. the suction side of the fan pump prior to thick stock addition, and the polymer flocculant to the thin stock line.

In another preferred method of addition, the modified diallyl-N,N-disubstituted ammonium halide polymer is added to the dilution head box stream and the polymer flocculant is added to the thin stock line.

In another preferred method of addition, the modified diallyl-N,N-disubstituted ammonium halide polymer is added to thick stock, e.g. stuff box, machine chest or blend chest, followed by addition of the polymer flocculant in the thin stock line.

In another preferred method of addition, the modified diallyl-N,N-disubstituted ammonium halide polymer and the polymer flocculant are fed simultaneously to the thin stock.

In another preferred method of addition, the modified diallyl-N,N-disubstituted ammonium halide polymer and the polymer flocculant are fed simultaneously to the dilution head box stream.

In another preferred aspect, one or more coagulants are added to the furnish.

Water soluble coagulants are well known, and commercially available. The water soluble coagulants may be inorganic or organic. Representative inorganic coagulants include alum, sodium aluminate, polyaluminum chlorides or PACs (which also may be under the names aluminum chlorohydroxide, aluminum hydroxide chloride and polyaluminum hydroxychloride), sulfated polyaluminum chlorides, polyaluminum silica sulfate, ferric sulfate, ferric chloride, and the like and blends thereof.

Many water soluble organic coagulants are formed by condensation polymerization. Examples of polymers of this type include epichlorohydrin-dimethylamine, and epichlorohydrin-dimethylamine-ammonia polymers.

Additional coagulants include polymers of ethylene dichloride and ammonia, or ethylene dichloride and dimethylamine, with or without the addition of ammonia, condensation polymers of multifunctional amines such as diethylenetriamine, tetraethylenepentamine, hexamethylenediamine and the like with ethylenedichloride and polymers made by condensation reactions such as melamine formaldehyde resins.

Additional coagulants include cationically charged vinyl addition polymers such as polymers and copolymers of diallyldimethylammonium chloride, dimethylaminoethylmethacrylate, dimethylaminoethylmethacrylate methyl chloride quaternary salt, methacrylamidopropyltrimethylammonium chloride, (methacryloxyloxyethyl)trimethyl ammonium chloride, diallylmethyl(beta-propionamido)ammonium chloride, (beta-methacryloxyloxyethyl)trimethyl-ammonium methylsulfate, quaternized polyvinyllactam, dimethylamino-ethylacrylate and its quaternary ammonium salts, vinylamine and acrylamide or methacrylamide which has been reacted to produce the Mannich or quaternary Mannich derivatives. The molecular weights of these cationic polymers, both vinyl addition and condensation, range from as low as several hundred to as high as one million. Preferably, the molecular weight range should be from about 20,000 to about 1,000,000.

Preferred coagulants are poly(diallyldimethylammonium chloride), EPI/DMA, $NH_3$ crosslinked and polyaluminum chlorides.

The foregoing may be better understood by reference to the following examples which are presented for purposes of illustration and are not intended to limit the scope of the invention.

EXAMPLE 1

Preparation of an Unmodified 70/30 Mole Percent Acrylamide/Diallyldimethyl Ammonium Chloride Copolymer Dispersion (Polymer I).

To a 1500 ml reaction flask fitted with a mechanical stirrer, thermocouple, condenser, nitrogen purge tube, and addition port is added 28.0 g of a 49.4 percent aqueous solution of acrylamide (Nalco Company, Naperville, Ill.), 175.0 g of a 63 percent aqueous solution of diallyldimethyl ammonium chloride (Nalco Company, Naperville, Ill.), 44.0 g of a 15 percent aqueous solution of a homopolymer of dimethylaminoethyl acrylate methyl chloride quaternary salt (Nalco Company, Naperville, Ill.), 0.66 g of sodium formate, 0.44 g of ethylenediaminetetraacetic acid, tetra sodium salt, 220.0 g of ammonium sulfate, 44.0 g sodium sulfate, 0.20 g polysilane antifoam (Nalco Company, Naperville, Ill.), and 332.0 g of deionized water. The resulting mixture is stirred and heated to 42° C. Upon reaching 42° C., 5.0 g of a 10.0 percent aqueous solution of 2,2'-azobis[2-(2-imidazolin-2-yl)propane]dihydrochloride (VA-044, Wako Chemicals, Dallas, Tex.) is added to the reaction mixture and a nitrogen purge is started at the rate of 1000 mL/min. Forty-five minutes after initiator addition, 194.7 g of a 49.4 percent aqueous solution of acrylamide is added to the reaction mixture over a period of 6 hours. At 8 hours after the initiator addition, the reaction mixture is cooled to ambient temperature. The product is a smooth milky white dispersion with a bulk viscosity of 1500 cP and a reduced specific viscosity of 4.5 dL/g (0.045 percent solution of the polymer in 1.0 N aqueous sodium nitrate at 30° C.). The charge density of the resulting polymer is 3.6 milliequivalents/gram polymer.

EXAMPLE 2

Preparation of a Modified 70/30 Mole Percent Acrylamide/Diallyldimethyl Ammonium Chloride Copolymer Dispersion (Polymer II).

To a reaction flask as described in Example 1 is added 129.2 g of a 49.4 percent aqueous solution of acrylamide, 162.1 g of a 63 percent aqueous solution of diallyldimethyl ammonium chloride, 60.6 g of a 15 percent aqueous solution of a homopolymer of dimethylaminoethyl acrylate methyl chloride quaternary salt, 0.25 g of sodium formate, 0.41 g of ethylenediaminetetraacetic acid, tetra sodium salt, 240.4 g of ammonium sulfate, 32.1 g sodium sulfate, 0.23 g polysilane antifoam, and 277.7 g of deionized water. The resulting mixture is stirred and heated to 42° C. Upon reaching 42° C., 4.7 g of a 10.0 percent aqueous solution of VA-044 is added to the reaction mixture and a nitrogen purge is started at the rate of 1000 mL/min. Two hours after the first initiator addition, 4.7 g of a 10.0 percent aqueous solution of VA-044 is added to the reaction mixture. Four hours after the first initiator addition, 3.4 g of a 10.0 percent aqueous solution of VA-044 and 0.05 g of sodium hypophosphite are added to the reaction mixture. After addition of third initiator, 84.3 g of a 49.4 percent aqueous solution of acrylamide is added to the reaction mixture over a period of 6 hours. At 12 hours after the first initiator addition, the reaction mixture is cooled to ambient temperature. The product is a smooth milky white dispersion with a bulk viscosity of 910 cP and a reduced specific viscosity of 5.7 dL/g (0.045 percent solution of the polymer in 1.0 N aqueous sodium nitrate at 30° C.). The modified polymer has a charge density of 4.1 milliequivalents/gram polymer.

EXAMPLE 3

Preparation of a Modified 70/30 Mole Percent Acrylamide/Diallyldimethyl Ammonium Chloride Copolymer Dispersion (Polymer III).

To a reaction flask as described in Example 1 is added 129.2 g of a 49.4 percent aqueous solution of acrylamide, 162.1 g of a 63 percent aqueous solution of diallyldimethyl ammonium chloride, 60.6 g of a 15 percent aqueous solution of a homopolymer of dimethylaminoethyl acrylate methyl chloride quaternary salt, 0.25 g of sodium formate, 0.41 g of ethylenediaminetetraacetic acid, tetra sodium salt, 240.4 g of ammonium sulfate, 32.1 g sodium sulfate, 0.23 g polysilane antifoam, and 277.7 g of deionized water. The resulting mixture is stirred and heated to 42° C. Upon reaching 42° C., 4.7 g of a 10.0 percent aqueous solution of VA-044 is added to the reaction mixture and a nitrogen purge is started at the rate of 1000 mL/min. Two hours after the first initiator addition, 4.7 g of a 10.0 percent aqueous solution of VA-044 is added to the reaction mixture. Four hours after the first initiator addition, 3.4 g of a 10.0 percent aqueous solution of VA-044 is added to the reaction mixture. After addition of third initiator, 84.3 g of a 49.4 percent aqueous solution of acrylamide is added to the reaction mixture over a period of 6 hours. At 12 hours after the first initiator addition, the reaction mixture is cooled to ambient temperature. The product is a smooth milky white dispersion with a bulk viscosity of 1300 cP and a reduced specific viscosity of 2.4 dL/g (0.045 percent solution of the polymer in 1.0 N aqueous sodium nitrate at 30° C.). The modified polymer has a charge density of 2.6 milliequivalents/gram polymer.

EXAMPLE 4

Preparation of a Modified 60/40 Mole Percent Acrylamide/Diallyldimethyl Ammonium Chloride Copolymer Dispersion (Polymer V).

To a 1500 ml reaction flask fitted with a mechanical stirrer, thermocouple, condenser, nitrogen purge tube, and addition port is added 121.9 g of a 49.4 percent aqueous solution of acrylamide, 218.6 g of a 63 percent aqueous solution of diallyldimethyl ammonium chloride, 57.6 g of a 15 percent aqueous solution of a homopolymer of dimethylaminoethyl acrylate methyl chloride quaternary salt, 0.24 g of sodium formate, 0.45 g of ethylenediaminetetraacetic acid, tetra sodium salt, 227.0 g of ammonium sulfate, 30.0 g sodium sulfate, 0.20 g polysilane antifoam and 281.7 g of deionized water. The resulting mixture is stirred and heated to 42° C. Upon reaching 42° C., 4.5 g of a 10.0 percent aqueous solution of VA-04 is added to the reaction mixture and a nitrogen purge is started at the rate of 1000 mL/min. Two hours after the first initiator addition, 4.5 g of a 10.0 percent aqueous solution of VA-044 is added to the reaction mixture. Four hours after the first initiator addition, 3.3 g of a 10.0 percent aqueous solution of VA-044 is added to the reaction mixture. After addition of third initiator, 50.0 g of a 49.4 percent aqueous solution of acrylamide is added to the reaction mixture over a period of 6 hours. At 12 hours after the first initiator addition, the reaction mixture is cooled to ambient temperature. The product is a smooth milky white dispersion with a bulk viscosity of 2300 cP and a reduced specific viscosity of 4.1 dL/g (0.045 percent solution of the polymer in 1.0 N aqueous sodium nitrate at 30° C.). The modified polymer has a charge density of 3.7 milliequivalents/gram polymer.

EXAMPLE 5

Preparation of a Modified 60/40 Mole Percent Acrylamide/Diallyldimethyl Ammonium Chloride Copolymer Dispersion (Polymer VII).

To a reaction flask as described in Example 1 is added 121.9 g of a 49.4 percent aqueous solution of acrylamide, 218.6 g of a 63 percent aqueous solution of diallyldimethyl ammonium chloride, 57.6 g of a 15 percent aqueous solution of a homopolymer of dimethylaminoethyl acrylate methyl chloride quaternary salt, 0.24 g of sodium formate, 0.45 g of ethylenediaminetetraacetic acid, tetra sodium salt, 227.0 g of ammonium sulfate, 30.0 g sodium sulfate, 0.20 g polysilane antifoam, and 281.7 g of deionized water. The resulting mixture is stirred and heated to 42° C. Upon reaching 42° C., 4.5 g of a 10.0 percent aqueous solution of VA-044 is added to the reaction mixture and a nitrogen purge is started at the rate of 1000 mL/min. Two hours after the first initiator addition, 4.5 g of a 10.0 percent aqueous solution of VA-044 is added to the reaction mixture. Four hours after the first initiator addition, 3.3 g of a 10.0 percent aqueous solution of VA-044 and 0.04 g of sodium hypophosphite are added to the reaction mixture. After addition of third initiator, 50.0 g of a 49.4 percent aqueous solution of acrylamide is added to the reaction mixture over a period of 6 hours. At 12 hours after the first initiator addition, the reaction mixture is cooled to ambient temperature. The product is a smooth milky white dispersion with a bulk viscosity of 2725 cP and a reduced specific viscosity of 4.7 dL/g (0.045 percent solution of the polymer in 1.0 N aqueous sodium nitrate at 30° C.). The modified polymer has a charge density of 4.8 milliequivalents/gram polymer.

EXAMPLE 6

Comparison of Modified and Unmodified Polymers.

A 1 percent polymer solution is prepared by stirring 198 g of water in a 400 mL beaker at 800 rpm using a cage stirrer, injecting two g of a polymer composition prepared as described in Examples 1-5 along the vortex and stirring for 30 minutes. The resulting product solution is used for Colloid titration as described below. The Colloid titration should be carried out within 4 hours of solution preparation.

The one percent polymer solution (0.3 g) is measured into a 600 mL beaker and the beaker is filled with 400 mL of deionized water. The solution pH is adjusted to 2.8 to 3.0 using dilute HCl. Toluidine Blue dye (6 drops) is added and the solution is titrated with 0.0002 N polyvinylsulfonate potassium salt to the end point (the solution should change from blue to purple). The charge density in milliequivalent per gram of polymer is calculated as follows:

$$\frac{(\text{mL } PVSK \text{ titrant used}) \times (\text{normality of } PVSK \text{ titrant})}{\text{mass of polymer titrated}} = \frac{\text{meq}}{\text{g polymer}}$$

The results are shown in Table 1.

TABLE 1

Comparison of Modified and Unmodified Polymers

| Sample | Composition | Sodium formate/sodium hypophosphite Level (ppm based on monomer) | Expected experimental charge density | Measured charge density (milliequivalents/gram polymer) | RSV (dL/g) |
|---|---|---|---|---|---|
| I | 30/70 mole percent DADMAC/Acrylamide | 3,000/0 | 3.1-4.3 | 3.6 | 4.5 |
| II | 30/70 mole percent DADMAC/Acrylamide | 1200/240 | 3.1-4.3 | 4.1 | 5.7 |
| III | 30/70 mole percent DADMAC/Acrylamide | 1200/0 | 3.1-4.3 | 2.6 | 2.4 |
| IV | 40/60 mole percent DADMAC/Acrylamide | 300/0 | 3.9-4.9 | 2.7 | 2.5 |
| V | 40/60 mole percent DADMAC/Acrylamide | 1080/0 | 3.9-4.9 | 3.7 | 4.1 |

TABLE 1-continued

Comparison of Modified and Unmodified Polymers

| Sample | Composition | Sodium formate/sodium hypophosphite Level (ppm based on monomer) | Expected experimental charge density | Measured charge density (milliequivalents/gram polymer) | RSV (dL/g) |
|---|---|---|---|---|---|
| VI | 40/60 mole percent DADMAC/Acrylamide | 100/0[1] | 3.9-4.9 | 3.0 | 2.2 |
| VII | 40/60 mole percent DADMAC/Acrylamide | 1080/180[2] | 3.9-4.9 | 4.8 | 4.7 |

[1]Modified 40/60 mole percent DADMAC/Acrylamide copolymer dispersion prepared according to the method of Example 4 using the indicated amount of sodium formate.
[2]Modified 40/60 mole percent DADMAC/Acrylamide copolymer dispersion prepared using sodium formate and sodium hypophosphite according to the method of Example 5.

The data shown in Table 1 indicate that polymers prepared according to the method of this invention are modified relative to polymers prepared as in U.S. Pat. No. 6,071,379 as described in Example 1.

EXAMPLE 7

Tables 3-7 show the results of retention testing on Light Weight Coated (LWC) and newsprint papermaking furnishes treated with representative modified polymers compared to conventional microparticles and a high molecular weight flocculent.

The retention testing is conducted using a Dynamic Drainage Jar (DDJ) according to the procedure described in TAPPI Test Method T 261 cm-94. Increased retention of fines and fillers is indicated by a decrease in the turbidity of the DDJ or expressed as higher First Pass Retention (FPR).

A 125P (76 μm) screen is used throughout the testing and the shear rate is kept constant at 1000 rpm. Table 2 shows the typical timing sequence for DDJ testing.

TABLE 2

Timing sequence used in DDJ retention measurements.

| Time (s) | Action |
|---|---|
| 0 | Start mixer and add sample furnish |
| 10 | Add coagulant if desired |
| 20 | Add flocculant if desired |
| 25 | Add modified diallyl-N,N-disubstituted ammonium halide polymer or conventional microparticle |
| 30 | Open drain valve and start collecting the filtrate |
| 60 | Stop collecting the filtrate |

TABLE 3

Retention Performance Comparison as FPR for Polymer V and Polymer VII vs. Bentonite or Colloidal Borosilicate in LWC Furnish[1]

| Program | Medium Dose | High Dose |
|---|---|---|
| | percent FPR | |
| No Microparticle | 87.18 | |
| Bentonite | 87.73 | 87.94 |
| Colloidal borosilicate | 87.16 | 88.53 |

TABLE 3-continued

Retention Performance Comparison as FPR for Polymer V and Polymer VII vs. Bentonite or Colloidal Borosilicate in LWC Furnish[1]

| Program | Medium Dose | High Dose |
|---|---|---|
| Polymer V | 89.21 | 91.18 |
| Polymer VII | 90.3 | 92.4 |

[1]10 lb/t starch; 0.5 lb/t cationic flocculant (10/90 mole percent dimethylaminoethylacrylate methyl chloride salt/acrylamide inverse emulsion polymer, average RSV 26 dL/g); bentonite dosed at 4 and 8 lb/t; colloidal borosilicate and Polymer V and Polymer VII dosed at 1.0 and 1.5 lb/t.

The data shown in Table 3 indicate significant improvement in performance in terms of FPR for representative polymers V and VII in combination with 10/90 mole percent dimethylaminoethylacrylate methyl chloride salt/acrylamide inverse emulsion polymer compared to existing conventional microparticle technologies such as bentonite and colloidal borosilicate.

TABLE 4

Retention Performance Comparison as FPR for Polymer V and Polymer VII vs. Bentonite and Colloidal Borosilicate in LWC Furnish[1]

| Program | FPR (percent) |
|---|---|
| No Microparticle | 87.51 |
| Bentonite | 88.09 |
| Colloidal borosilicate | 84.92 |
| Polymer V | 92.81 |
| Polymer VII | 91.91 |

[1]10 lb/t starch; 0.5 lb/t anionic flocculant (30/70 mole percent sodium acrylate/acrylamide inverse emulsion polymer, average RSV 40 dL/g); bentonite dosed at 4 lb/t; colloidal borosilicate, Polymer V and Polymer VII dosed at 1.0 lb/t.

As shown in Table 4, in LWC furnish representative modified polymers V and VII in combination with 30/70 mole percent sodium acrylate/acrylamide inverse emulsion polymer show superior performance compared to the existing microparticles, bentonite and colloidal borosilicate.

TABLE 5

Retention Performance Comparison as FPR for Polymer VII vs. Bentonite in LWC Furnish[1]

| Polymer | Dose lb/t | FPR (percent) | Turbidity (NTU) | Turbidity Reduction (percent) |
|---|---|---|---|---|
| starch blank | — | 53.4 | 4248.0 | 0.0 |
| Cationic flocculant alone | 0.5 | 64.4 | 3294.0 | 22.5 |
| Bentonite | 4.0 | 64.6 | 3066.0 | 27.8 |
| | 8.0 | 66.3 | 2955.0 | 30.5 |
| Polymer VII | 0.5 | 67.4 | 2874 | 32.35 |
| | 1.0 | 72.9 | 2391 | 43.72 |

[1]10 lb/t starch; poly(diallyldimethylammonium chloride) dosed at 3 lb/t; 0.5 lb/t cationic flocculant (10/90 mole percent dimethylaminoethylacrylate methyl chloride salt/acrylamide inverse emulsion polymer, average RSV 26 dL/g); bentonite dosed at 4 lb/t and 8 lb/t; and Polymer VII dosed at 0.5 and 1.0 lb/t.

As shown in Table 5, in another furnish representative polymer VII, in combination with 10/90 mole percent dimethylaminoethylacrylate methyl chloride salt/acrylamide inverse emulsion polymer shows superior performance to bentonite at low and high dosage levels.

TABLE 6

Retention Performance Comparison as FPR for Polymer VII vs. Bentonite in LWC Furnish[1]

| Polymer | Dose lb/t | FPR (percent) | Turbidity (NTU) | Turbidity Reduction (percent) |
|---|---|---|---|---|
| starch blank | — | 53.4 | 4248.0 | 0.0 |
| Anionic flocculant alone | 0.5 | 56.4 | 3945.0 | 7.1 |
| Bentonite | 8.0 | 58.8 | 3546.0 | 16.5 |
| Polymer VII | 1.0 | 67.9 | 2831 | 33.36 |

[1]10 lb/t starch; poly(diallyldimethylammonium chloride) dosed at 3 lb/t; 0.5 lb/t 30/70 mole percent sodium acrylate/acrylamide inverse emulsion polymer, average RSV 40 dL/g.; bentonite dosed at 4 lb/t and 8 lb/t; and Polymer VII dosed at 0.5 and 1.0 lb/t.

As shown in Table 6, in another LWC furnish representative modified polymer VII, in combination with the 30/70 mole percent sodium acrylate/acrylamide inverse emulsion polymer show superior performance compared to bentonite in terms of FPR and turbidity reduction.

TABLE 7

Retention Performance Comparison of Polymers IV and VII vs. Bentonite and Colloidal Borosilicate in Newsprint Furnish[1]

| Polymer | Dosage lb/t | Turbidity (NTU) | FPR (percent) | Turbidity Reduction |
|---|---|---|---|---|
| starch blank | — | 4282 | 73.3 | 0.0 |
| Cationic Flocculant alone | 1.0 | 2908 | 80.5 | 32.1 |
| Colloidal borosilicate | 1.0 | 2682 | 81.3 | 37.4 |
| | 2.0 | 2385 | 83.1 | 44.3 |
| Bentonite | 2.0 | 2999 | 79.1 | 30.0 |
| | 4.0 | 2363 | 84.4 | 44.8 |
| Polymer IV | 1.0 | 2743 | 81.8 | 35.9 |
| | 2.0 | 2485 | 83.1 | 42.0 |

TABLE 7-continued

Retention Performance Comparison of Polymers IV and VII vs. Bentonite and Colloidal Borosilicate in Newsprint Furnish[1]

| Polymer | Dosage lb/t | Turbidity (NTU) | FPR (percent) | Turbidity Reduction |
|---|---|---|---|---|
| Polymer VII | 1.0 | 2262 | 83.4 | 47.2 |
| | 2.0 | 1436 | 89.4 | 66.5 |

[1]8 lb/t starch; 1.0 lb/t 10/90 mole percent dimethylaminoethylacrylate methyl chloride salt/acrylamide inverse emulsion polymer, average RSV 26 dL/g; bentonite dosed at 2.0 and 4.0 lb/t; Polymers IV and VII dosed at 1.0 and 2.0 lb/t.

As shown in Table 7 for a typical newsprint furnish, representative modified polymers IV and VII in combination with a 10/90 mole percent dimethylaminoethylacrylate methyl chloride salt/acrylamide inverse emulsion polymer show improved performance compared to bentonite and colloidal borosilicate in terms of FPR and turbidity reduction.

EXAMPLE 8

Tables 9 and 10 show the results of drainage testing on a LWC papermaking furnish treated with representative modified polymers and a high molecular weight flocculant in the presence and absence of a conventional microparticle.

Drainage measurements are performed using the Dynamic Filtration System (DFS-03) Manufactured by Mutek (BTG, Herrching, Germany). During drainage measurement using the Dynamic Filtration System, the furnish (pulp suspension) is filled into the stirring compartment and subjected to a shear of 650 rpm during the addition of the chemical additives. The furnish is drained through a 60 mesh screen with 0.17 mm wire size for 60 seconds and the filtrate amount is determined gravimetrically over the drainage period. The results are given as the drainage rate (g/sec). The drainage is evaluated using the test conditions shown in Table 8.

TABLE 8

DFS-03 Test Conditions

| | |
|---|---|
| Mixing Speed | 650 rpm |
| Screen | 60 Mesh |
| Sample Size | 1000 ml |
| Shear Time | 30 sec |
| Collection Time | 60 sec |
| Dosing Sequence | |
| t = 0 sec | Start |
| t = 5 sec | Coagulant |
| t = 10 sec | Starch |
| t = 20 sec | Flocculant |
| t = 25 sec | Microparticle |
| t = 30 sec | Drain |
| t = 90 sec | STOP |

TABLE 9

Drainage Performance Comparison for Polymer V and Polymer VII vs. Bentonite in LWC Furnish

| | Drainage Rate g/sec | |
|---|---|---|
| | Medium | High |
| Cationic flocculant 1[1]/ Bentonite[2] | 12.77 | 14.42 |
| Cationic flocculant 2[3]/ Bentonite | 16.48 | 16.85 |

TABLE 9-continued

| Drainage Performance Comparison for Polymer V and Polymer VII vs. Bentonite in LWC Furnish | Drainage Rate g/sec | |
|---|---|---|
| | Medium | High |
| Cationic flocculant 1[1]/ Polymer V[4] | 16.13 | 17.75 |
| Cationic flocculant 1[1]/ Polymer VII[4] | 16.57 | 17.96 |
| Cationic flocculant 2[3]/ Polymer V[4] | 17.44 | 20.41 |
| Cationic flocculant 2[3]/ Polymer VII[4] | 17.65 | 19.11 |

[1]10/90 mole percent dimethylaminoethylacrylate methyl chloride salt/acrylamide inverse emulsion polymer, average RSV 26 dL/g, dosed at 0.5 lb/t.
[2]Bentonite dosed at 4 and 8 lb/t.
[3]5/95 mole percent structurally modifed dimethylaminoethylacrylate methyl chloride salt/acrylamide inverse emulsion polymer, U.S. Pat. No. 6,605,674, dosed at 0.5 lb/t.
[4]Polymer V and Polymer VII dosed at 1 and 1.5 lb/t.

In Table 9, the effect of Polymers V, VII and bentonite on drainage is compared in combination with 10/90 mole percent dimethylaminoethylacrylate methyl chloride salt/acrylamide inverse emulsion polymer or 5/95 mole percent structurally modified dimethylaminoethylacrylate methyl chloride salt/acrylamide inverse emulsion polymer. Medium and high dosage levels of the microparticles are applied. Polymers V and VII show significant improvement in drainage compared to bentonite.

TABLE 10

| Drainage Performance Comparison for Polymer VII vs. Bentonite in LWC Furnish[1] | Drainage Rate g/sec |
|---|---|
| No Microparticle | 5.2 |
| Bentonite @ 6 lb/t | 5.94 |
| Polymer VII @ 3 lb/t | 11.11 |

[1]10 lb/t starch; poly(diallyldimethylammonium chloride) dosed at 0.5 lb/t; and 1.0 lb/t 10/90 mole percent dimethylaminoethylacrylate methyl chloride salt/acrylamide inverse emulsion polymer, average RSV 26 dL/g.

In Table 10, the effect on drainage of Polymer VII and bentonite in combination with 10/90 mole percent dimethylaminoethylacrylate methyl chloride salt/acrylamide inverse emulsion polymer is measured. Polymer VII shows significant improvement in drainage compared to bentonite.

Changes can be made in the composition, operation and arrangement of the method of the invention described herein without departing from the concept and scope of the invention as defined in the claims.

The invention claimed is:

1. A method of preparing a modified diallyl-N,N-disubstituted ammonium halide polymer having a cationic charge of about 1 to about 99 mole percent comprising (a) preparing an aqueous solution comprising one or more diallyl-N,N-disubstituted ammonium halide monomers, about 35 to about 85 percent of the total acrylamide monomer, about 0.1 to about 150,000 ppm, based on monomer, of one or more chain transfer agents and optionally about 1 to about 30,000 ppm, based on monomer, of one or more cross-liking agents;

(b) initiating polymerization of the monomers;

(c) allowing the polymerization to proceed to at least about 5 percent diallyl-N,N-disubstituted ammonium halide monomer conversion and at least about 20 percent acrylamide monomer conversion; and (d) adding the remaining acrylamide monomer and allowing the polymerization to proceed to the desired endpoint, wherein the modified diallyl-N,N-disubstituted ammonium halide polymer has a RSV of from about 0.2 to about 12 dL/g and a charge density of less than about 7 milliequivalents/g polymer.

2. The method of claim 1 wherein the modified diallyl-N,N-disubstituted ammonium halide polymer is selected from the group consisting of inverse emulsion polymers, dispersion polymers, solution polymers and gel polymers.

3. The method of claim 1 wherein the diallyl-N,N-disubstituted ammonium halide monomer is diallyldimethylammonium chloride and the acrylamide monomer is acrylamide.

4. The method of claim 3 wherein the modified diallyl-N,N-disubstituted ammonium halide polymer has a cationic charge of about 20 to about 80 mole percent.

5. The method of claim 4 wherein the modified diallyl-N,N-disubstituted ammonium halide polymer has a RSV of about 1 to about 10 dL/g.

6. The method of claim 5 wherein the chain transfer agent is selected from sodium formate and sodium hypophosphite.

7. The method of claim 5 wherein the polymerization is conducted in the presence of about 0.1 to about 50,000 ppm, based on monomer, of sodium formate.

8. The method of claim 5 wherein the polymerization is conducted in the presence of about 0.1 to about 30,000 ppm, based on monomer, of sodium formate.

9. The method of claim 5 wherein the polymerization is conducted in the presence of about 0.1 to about 10,000 ppm, based on monomer, of sodium formate.

10. The method of claim 5 wherein the polymerization is conducted in the presence of about 0.1 to about 3,000 ppm, based on monomer, of sodium formate.

11. The method of claim 4 wherein the polymerization is conducted in the presence of about 0.1 to about 150,000 ppm, based on monomer, of chain transfer agent and about 1 to about 30,000 ppm, based on monomer, of cross-linking agent.

12. The method of claim 4 wherein the polymerization is conducted in the presence of about 0.1 to about 50,000 ppm, based on monomer, of chain transfer agent and about 1 to about 2,000 ppm, based on monomer, of cross-linking agent.

13. The method of claim 4 wherein the polymerization is conducted in the presence of about 0.1 to about 10,000 ppm, based on monomer, of chain transfer agent and about 5 to about 500 ppm, based on monomer, of cross-linking agent.

14. The method of claim 13 wherein the chain transfer agent is sodium formate and the cross-linking agent is N,N-methylenebisacrylamide.

15. The method of claim 1 wherein the modified diallyl-N,N-disubstituted ammonium halide polymer is composed of about 30 to about 70 mole percent diallyldimethylammonium chloride monomer and about 30 to about 70 mole percent acrylamide monomer and has a charge density of less than about 7 milliequivalents/g polymer and a RSV of less than about 10 dL/g.

16. A method of increasing retention and drainage in a papermaking furnish comprising adding to the furnish an effective amount of a modified diallyl-N,N-disubstituted ammonium halide polymer prepared according to the method of claim 1 and an effective amount of one or more high molecular weight, water-soluble cationic, anionic, nonionic, zwitterionic or amphoteric polymer flocculants.

17. The method of claim 16 wherein the high molecular weight, water soluble cationic, anionic, nonionic, zwitterionic or amphoteric polymer flocculants have a RSV of at least about 3 dL/g.

18. The method of claim 16 wherein the high molecular weight, water soluble cationic, anionic, nonionic, zwitterionic or amphoteric polymer flocculants have a RSV of at least about 10 dL/g.

19. The method of claim 16 wherein the high molecular weight, water soluble cationic, anionic, nonionic, zwitterionic or amphoteric polymer flocculants have a RSV of at least about 15 dL/g.

20. The method of claim 16 wherein the polymer flocculant is selected from the group consisting of dimethylaminoethylacrylate methyl chloride quaternary salt-acrylamide copolymers.

21. The method of claim 16 wherein the polymer flocculant is selected from the group consisting of sodium acrylate-acrylamide copolymers and hydrolyzed polyacrylamide polymers.

22. The method of claim 16 further comprising adding one or more coagulants to the furnish.

23. The method of claim 22 wherein the coagulant is selected from EPI/DMA, $NH_3$ crosslinked, poly(diallyldimethylammonium chloride) and polyaluminum chlorides.

24. The method of claim 16 wherein the modified N,N-diallyl disubstituted ammonium halide polymer and the polymer flocculant are added to the thin stock.

25. The method of claim 16 wherein the modified N,N-diallyl disubstituted ammonium halide polymer is added before the polymer flocculant.

26. The method of claim 16 wherein the modified N,N-diallyl disubstituted ammonium halide polymer is added after the polymer flocculant.

27. The method of claim 16 wherein the modified N,N-diallyl disubstituted ammonium halide polymer is added to tray water and the polymer floccullant is added to the thin stock line.

28. The method of claim 16 wherein the modified N,N-diallyl disubstituted ammonium halide polymer is added to the dilution head box stream and the polymer flocculant is added to the thin stock line.

29. The method of claim 16 wherein the modified N,N-diallyl disubstituted ammonium halide polymer is added to the thick stack and the polymer flocculant is added to the thin stock line.

30. The method of claim 16 wherein the modified N,N-diallyl disubstituted ammonium halide polymer and the polymer flocculant are added simultaneously to the thin stock.

31. The method of claim 16 wherein the modified N,N-diallyl disubstituted ammonium halide polymer and the polymer flocculant are added simultaneously to the dilution headbox stream.

* * * * *